United States Patent [19]

Ikeuchi et al.

[11] Patent Number: 4,771,666

[45] Date of Patent: Sep. 20, 1988

[54] FOOD PROCESSING MACHINE FOR PRODUCING LONG FIBERS OF FOOD

[75] Inventors: Hiroji Ikeuchi; Kiyoaki Ikeuchi, both of Akashi, Japan

[73] Assignee: Kabushiki Kaisha Ikeuchi Tekkosho, Akashi, Japan

[21] Appl. No.: 815,632

[22] Filed: Jan. 2, 1986

[30] Foreign Application Priority Data

Jun. 10, 1985 [JP] Japan ..... 60-126498

[51] Int. Cl.[4] ..... B26D 1/22

[52] U.S. Cl. ..... 83/99; 83/98; 83/122; 83/506; 83/582; 83/665; 83/676

[58] Field of Search ..... 83/98, 99, 121, 122, 83/505, 506, 169, 676, 665; 241/236, 227, 229

[56] References Cited

U.S. PATENT DOCUMENTS 812,704 2/1906 DeVito ..... 83/122
980,145 12/1910 Dickson ..... 83/121
1,007,721 11/1911 Meyer ..... 83/121 X
2,637,395 5/1953 Muller ..... 83/505 X
4,300,421 11/1981 Yano et al. ..... 83/99

FOREIGN PATENT DOCUMENTS 559623 7/1968 Canada ..... 83/505
476332 5/1929 Fed. Rep. of Germany ..... 83/505

*Primary Examiner*—Frank T. Yost
*Attorney, Agent, or Firm*—Marshall, O'Toole, Gerstein, Murray & Bicknell

[57] ABSTRACT

This disclosure relates to a food processing machine for processing a sheet of gelatinous food material into a fibrous product. The machine includes a knife roller having a plurality of parallel annular disk-like blades, a counter roller having a cylindrical outer surface, and a nozzle for jetting a stream of a fluid from the sheet feeding side of the rollers. The jet of fluid flows between the annular blades of the rotating knife roller and prevents the food material from sticking to the blades.

1 Claim, 2 Drawing Sheets

FIG. 1
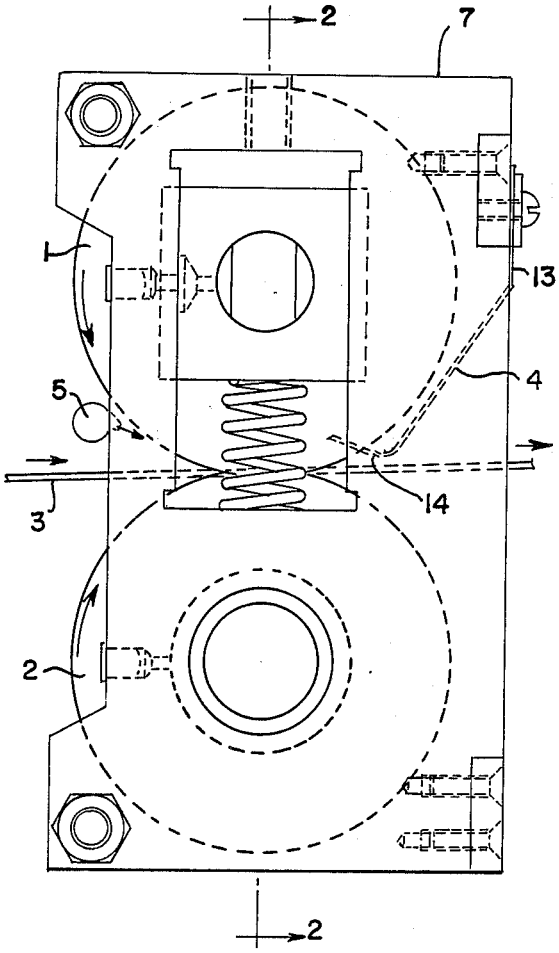
FIG. 4
PRIOR ART
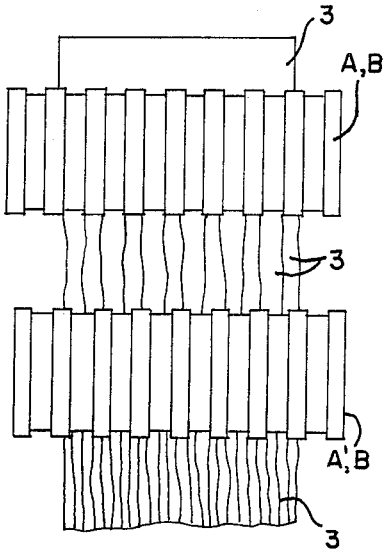
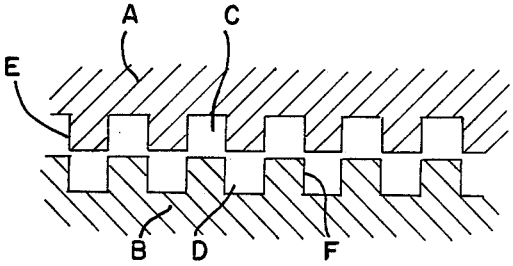
FIG. 3
PRIOR ART

FOOD PROCESSING MACHINE FOR PRODUCING LONG FIBERS OF FOOD

FIELD AND BACKGROUND OF THE INVENTION

The present invention relates to a machine for processing paste-like food materials into long fibers of food. More particularly, the present invention relates to a machine for forming, for example, a paste-like or gelatinous minced fish meat product into long fibers to produce a crab-arm-like texture, adductor-muscle-like texture or similarly textured foods. The machine is also applicable to processing of other foods such as noodles.

The conventional roller cutters used for cutting minced fish meat gelatinous foods into elongated fibers or strings use a method wherein a gelatinous food sheet is fed between a first roller having a plurality of parallel alternating annular ribs and grooves on its surface, and a second roller also having ribs and grooves corresponding to the first roller surface. The ribs of one roller are aligned with the grooves of the other roller, and the sheet is cut by a shearing action between the corners of the ribs of the two rollers. Accordingly, there is a machining limit to the reduction in the width of the ribs and grooves, and it is difficult to produce very thin and long fibers of foods. In the Patent Provisional Publication No. SHO-58-5169, an arrangement is disclosed, similar to that described above, wherein a sheet of food material is fed between an upper roller cutter having a large number of annular ribs and grooves and a lower roller cutter having a large number of annular ribs and grooves, and the sheet is sliced or shredded by the shearing action between the pairs of ribs. Further, a technique is described wherein a plurality of sets of such upper and lower rollers are arranged in series with their ribs out of phase to repeat a plurality of slicings and thereby reduce the width of fibers.

The above prior art arrangements are also shown in FIGS. 3 and 4. In FIG. 3, an upper roller A is provided with ribs E which form grooves C therebetween, and the lower roller B has similar ribs F and grooves D. The ribs of one of the rollers are matched with the grooves of the other roller and the corners of the ribs are closely adjacent each other to achieve a shearing action between the corners to shred a sheet of food material. As shown in FIG. 4, a plurality of sets of the rollers A, B and A', B' are arranged with their ribs and grooves offset or out of phase so that the food material 3 is shredded a second time.

When cutting of the food is effected by such shearing, it may have an adverse effect on the production; the cut surfaces of the food will be crushed during cutting and thereby become pastry, and the cut surfaces will tend to stick to auxiliary equipment during the ensuing transfer and take-up processes. This may result in a possible winding of several fibers around the equipment on the production line, and possibly a change in the appearance of the final product.

In the above-mentioned prior art, there are also the problems that it is difficult to increase the precision of machining of the roller grooves, and that a large number of machining operations are required to make the grooves of a roller.

Further, since the shredded fibers of the food material stick in the grooves of the rollers and are caught in the rollers, it is necessary to provide a comb plate to scrape the food material off from the rollers. This presents a problem because metal powder is generated from the rubbing contact between the comb plate and the rollers and the powder will mix with the food product.

It is a primary objective of the present invention to provide a food processing machine which solves the above-mentioned problems.

SUMMARY OF THE INVENTION

The present invention relates to a food processing machine for processing a sheet of gelatinous food material into a fibrous product, and comprises a knife roller having a plurality of parallel annular disk-like blades, a counter roller having a cylindrical outer surface, and a nozzle for jetting a stream of a fluid from the sheet feeding side of the rollers. The jet of fluid flows between the annular blades of the rotating knife roller and prevents the food material from sticking to the blades.

BRIEF DESCRIPTION OF THE DRAWINGS

The invention will be better understood from the following detailed description taken in conjunction with the accompanying figures of the drawings, wherein:

FIG. 1 is a side view illustrating a machine in accordance with a preferred embodiment of the present invention;

FIG. 3 is a fragmentary transverse sectional view illustrating the construction of blades of a prior art machine; and FIG. 4 is a plan view further illustrating the prior art machine.

DETAILED DESCRIPTION OF THE DRAWINGS

Figure 2:
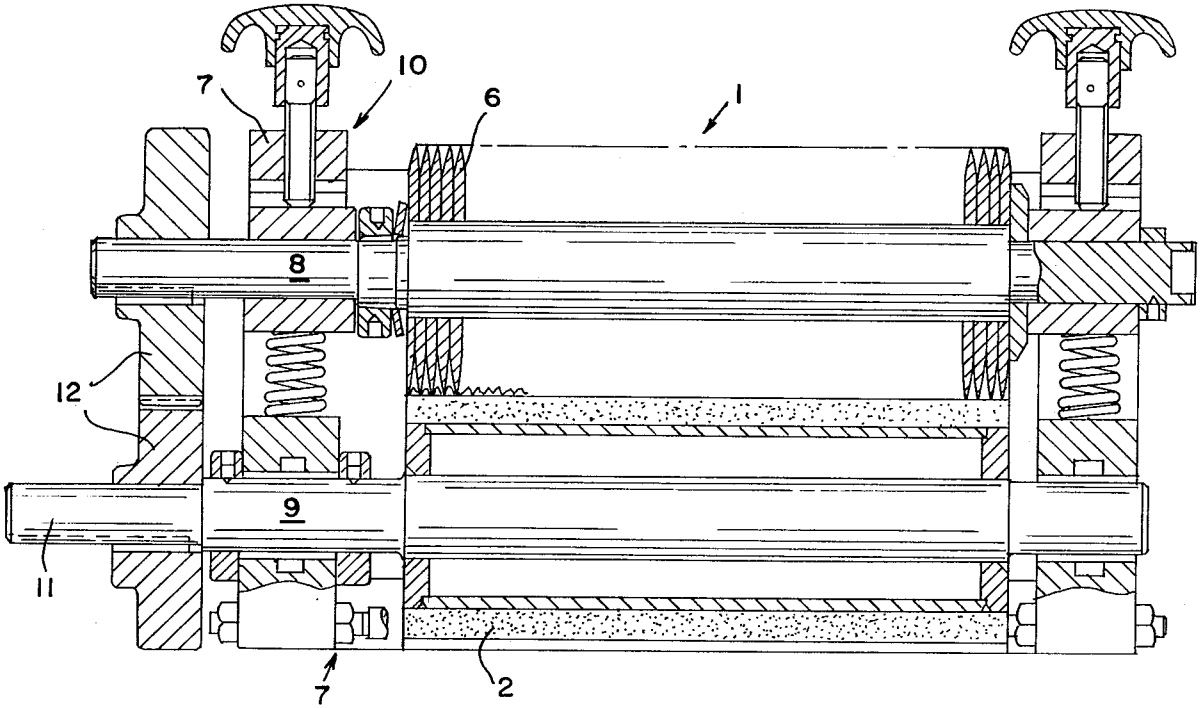
FIG. 2 is a sectional view along the line II—II of FIG. 1.

A machine for slicing or shredding a sheet of gelatinous food material, according to the present invention, comprises a knife roller 1 and a counter roller 2, the rollers being rotatably mounted on a machine frame 7 as shown in FIGS. 1 and 2. The axes of the two rollers fall in a substantially vertical plane, the roller 1 being directly above the roller 2. With reference to FIG. 2, the rollers 1 and 2 are supported by shafts 8 and 9, respectively, which are rotatably mounted on the frame 7. A mechanism 10 is provided to adjust the height of the roller 1 so that the periphery of the roller 1 is closely adjacent the periphery of the roller 2. The end 11 of the shaft 9 is connected to a suitable power drive (not shown), and gears 12 rotate the other shaft 8 so that the surface speeds of the two rollers 1 and 2 are substantially equal to the feeding speed of the sheet.

A sheet of food material 3 is fed between the upper and lower rollers from the left to the right in the direction of the arrow in FIG. 1, and at the same time the upper and lower rollers are rotated. The sliced or shredded food material 3 is passed through the nip and sent out to the right.

As shown in FIG. 2, the knife roller 1 is an assembly of disk-like circular metal blades 6 coaxially mounted on the shaft 8, the blades 6 having cutting edges on the circumferences. For example, when the thickness of a blade 6 is 0.8 mm, about 12 cutting lines can be made per each cm in width of the food material. The counter roller 2 has a smooth outer surface and may be made, for example, of silicone rubber.

With reference to FIG. 1, a nozzle 5 is provided for supplying a jet or stream of fluid into the spaces between the rollers. The nozzle 5 is mounted above the sheet of food material 3 on the feeding side of the rollers, and the jet is directed through the spaces between the blades and toward the upper surface of the food material. The nozzle 5 may be a pipe having a plurality of jet outlets formed on one side thereof, or a metal piece having an elongated slit-like straight narrow gap.

The fluid is preferably air but it could instead be a liquid such as water or an air-liquid mixture.

On the output or downstream side of the rollers is provided a scraper 4 which extends along the length of the rollers. One edge 13 of the scraper is secured to the frame, and the other edge 14 has a comb or rake configuration, the teeth of the comb-like edge 14 extending into the spaces between the blades 6 but preferably being out of contact with the blades. As shown in FIG. 1, the edge 14 is bent to a V-shape, and the space between the edge 14 and the product 3 narrows in the direction of movement of the product. The jet of fluid from the nozzle 5 will enter this narrowing space and press downwardly on the product to further prevent the product from moving up with the blades. The nozzle outlets are arranged to direct a stream or jet of fluid across the width of the rollers.

The sheet of food material, such as minced fish meat, is fed between the rollers and the upper and lower rollers are rotated to match the feed speed of the material. The food material is shredded by the push-and-cut action of the knife blades 6 against the counter roller 2 which serves as a chopping board, and the width of each fiber of food is determined by the spacing between two consecutive annular blades. Since the knife blades are made by stacking a large number of the annular blades on the shaft 8, the knife edges are narrowly spaced from each other. Further, the fluid is arranged to be forced out of the nozzle 5 from the food material supply side of the rollers. When the slicing or shredding by the knife blades is completed, the fluid jet passes between each piece of fibrous food material and the associated knife blades to remove the food material from the knife blades. Thus, the shredded fibers of food material can be fed to the following step in the process from the rollers without difficulty.

About twelve cutting lines for each cm can be made at a time. Since the mode of shredding is by press-to-cut rather than by shearing, the food material can be very smoothly processed into long fibers. Since the material is not crushed by the cutting, the food material maintains sharp cut edges and does not stick to the knife blades even when the moisture content of the food is rather high. Even if the food material should stick to the blades, the fluid jetting out of the nozzle 5 flows through the gaps between knife blades, and when the food material is bent and follows the circumference of the blades, the fluid will push the food sheet down and thus scrape off the cut fibers of food. The more the fibers of food are caught and tend to follow the circumference of the knife blades, the stronger will be the scraping force. In the foregoing description, the knife roller 1 is arranged above the counter roller 2. The arrangement of these rollers, however, may be varied according to the overall design of the processing facilities.

Thus, according to the present invention, the food material is fed between a knife roller having a plurality of parallel annular blades and a counter roller having a cylindrical surface, and the nozzle is provided for jetting fluid on the food material feeding side of the knife roller to form a jet of fluid between the blades of the knife roller so as to prevent the fibrous food material from sticking to the knife blades; consequently the shredding of food products from a sheet form can be accomplished very smoothly.

The present invention achieves push-to-cut shredding with sharp edges rather than the shear-type shredding of the prior art. Since the products are cut into the desired forms without having a large force exerted on them, the products retain a good taste. When a food material contains much moisture, the elasticity of the product is low and the product is rather hard to cut by prior art methods, but the machine according to the present invention assures easy processing even in this situation, and the sliced food products give a soft feeling to the tongue and the palate.

As distinguished from the prior art, the cutting mode according to the present invention is push-to-cut by cutting knives from one side of the product, and the traces of the cutting edges form wedges in cross section because of the taper of the blade cross section. Consequently the cut sheet can easily be transversely rolled inwards along the cut lines. This is an advantage when the fibers are rolled to form a bundle of fibers like crab kamaboko, a Japanese dish. Copending U.S. application Ser. No. 769,175 filed Aug. 26, 1985, now U.S. Pat. No. 4,622,228, is incorporated herein by reference.

Since the annular blades of the knife roller are separately formed, they can be individually replaced with a new one. This allows for replacement of a blade having a nicked edge, and blades of different thicknesses can be freely arranged on a single shaft so that food fibers of different thicknesses can be mixed in a single process.

What is claimed is:

1. A food processing machine for slicing a sheet of food material into long fibers, comprising a rotatable knife roller having a plurality of parallel blades, each of said blades having an annular cutting edge on its outer periphery, a rotatable counter roller having a cylindrical outer surface, said rollers having substantially parallel axes of rotation and said edges being closely adjacent said outer surface, said rollers being adapted to receive a sheet of food material therebetween from a feeding side of said rollers, a nozzle for jetting a fluid from said feeding side of said rollers, said fluid flowing between said annular blades and onto the sheet to prevent the food material from sticking to said blades, and a scraper mounted adjacent said blades and in the path of said fluid and deflecting said fluid onto the food material.

* * * * *